United States Patent [19]

Philippaerts et al.

[11] 4,202,695

[45] May 13, 1980

[54] PHOTOGRAPHIC LIPPMANN EMULSIONS

[75] Inventors: Herman A. Philippaerts, Edegem; Robert J. Pollet, Vremde, both of Belgium; Wolfgang Müller-Bardorff, Cologne, Fed. Rep. of Germany; Wilhelm Saleck, Schildgen, Fed. Rep. of Germany; Anita von König, Leverkusen, Fed. Rep. of Germany; Walter Gauss, Cologne, Fed. Rep. of Germany; Franz Moll, Leverkusen-Stinbuchel, Fed. Rep. of Germany; Theofiel H. Ghys, Kontich, Belgium

[73] Assignee: AGFA-GEVAERT N.V., Mortsel, Belgium

[21] Appl. No.: 545,742

[22] Filed: Jan. 30, 1975

Related U.S. Application Data

[63] Continuation of Ser. No. 311,160, Dec. 1, 1972, abandoned.

[30] Foreign Application Priority Data

Dec. 9, 1971 [DE] Fed. Rep. of Germany ..... 2161045

[51] Int. Cl.[2] ..... G03C 5/04; G03C 5/00; G03C 1/28

[52] U.S. Cl. ..... 430/8; 430/566; 430/568; 430/407; 430/429; 430/445

[58] Field of Search ..... 96/107, 109, 27R, 66.3, 96/67, 56.5, 59, 38.3

[56] References Cited

U.S. PATENT DOCUMENTS

| | | | |
|---|---|---|---|
| T904,022 | 11/1972 | Kurz et al. | 96/109 |
| 2,432,864 | 12/1947 | Dimsdale et al. | 96/85 |
| 3,615,617 | 10/1971 | Bardorff et al. | 96/109 |
| 3,615,618 | 10/1971 | Wise et al. | 96/109 |
| 3,632,345 | 1/1972 | Marx et al. | 96/109 |
| 3,637,393 | 1/1972 | Sakamoto et al. | 96/109 |
| 3,640,719 | 2/1972 | Konig et al. | 96/109 |
| 3,641,046 | 2/1972 | Gates et al. | 96/109 |
| 3,753,719 | 8/1973 | Sakamoto et al. | 96/109 |
| 3,841,877 | 10/1974 | Williams et al. | 96/66.3 |

*Primary Examiner*—Edward C. Kimlin
*Attorney, Agent, or Firm*—A. W. Breiner

[57] ABSTRACT

Fine-grain silver halide emulsions of the Lippmann-type are described which comprise derivatives of heterocyclic mercaptans corresponding to the formulae:

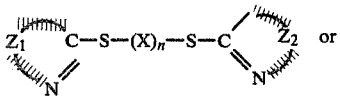

or

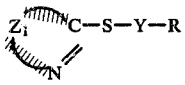

wherein:

each of $Z_1$ and $Z_2$ represents the atoms necessary to complete a 5- or 6-membered heterocyclic ring system, n is 0 or 1, X is —CO— or —CS—, R is an alkyl group or an aryl group, and Y is —CO—, —COO—, —CS—, —$SO_2$—, —CON($R_1$)— or —CSN($R_1$)—, $R_1$ being hydrogen, alkyl or aryl.

Both in reversal and negative processing sharpness of fine detail is improved and the distortion of image-details is reduced. Upon reversal processing yellow staining is also reduced.

6 Claims, No Drawings

PHOTOGRAPHIC LIPPMANN EMULSIONS

This is a continuation of application Ser. No. 311,160 filed Dec. 1, 1972, now abandoned.

The present invention relates to fine-grain silver halide emulsions of the Lippmann type.

Lippmann emulsions, normally having an average grain-size of less than 100 nm, are of particular importance for the preparation of photographic plates or films with high resolution, for use in microphotography, for recording nucleophysical phenomenons, for the preparation of masks in the production of microelectronic integrated circuits, for use in holography, for high-density data storage, etc.

For instance, in the production of microelectronic integrated circuits drawings are made on highly enlarged scale of the various successive masks necessary to produce one integrated circuit whereupon the drawings are reduced, if necessary in successive steps, and reproduced on a photographic plate or film material forming thereby the mask ready for use. By various photographic and chemical steps (photo-etching of lacquered plates) the images of the masks thus produced are transferred to the surface on which the integrated circuit is to be made, in order to produce the required circuit elements.

In the preparation of the masks, the exposed photographic elements can be subjected to negative processing or to reversal processing. As a matter of fact it is often difficult to position a mask produced by negative processing into register with integrated circuits, to which the images of previous masks have already been transferred, when image-details of the latter masks are smaller in size than the black image-details of the negative mask and thus are entirely hidden by the said black image-details. Proper registering can be achieved in these instances by the use of masks produced by reversal processing because the black image areas of the masks obtained on negative processing are fully transparent on reversal processing.

The photographic materials for use in the production of masks as described above should have a high resolving power and acutance, and allow a correct reproduction of the dimensions of the image. However, with the high-resolution Lippmann materials special problems are encountered. For instance, the images produced often show at certain areas distortions of image details, by mutual influence of closely adjacent image details. Moreover, the sharpness at the edges of the images, especially after reversal processing, does not always meet the requirements.

It has now been found that the above disadvantageous effects can be reduced or eliminated by incorporating in the Lippmann-emulsion compounds that hydrolyze in alkaline medium to form heterocyclic mercapto or thioxo compounds e.g. heterocyclic dithioesters of carbonic acid, heterocyclic disulphides, reaction products of heterocyclic mercaptans with acid chlorides or esters of chloroformic acid, heterocyclic isothiuronium salts, heterocyclic thioesters of carbamic acids, heterocyclic esters of dithiocarbamic acids, etc. Particularly suitable are derivatives of heterocyclic mercaptans corresponding to one of the following general formulae I and II:

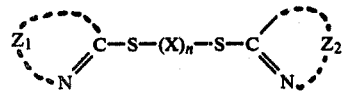

I.

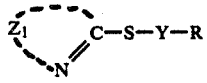

II.

wherein:

each of $Z_1$ and $Z_2$ represents the atoms necessary to complete a 5- or 6-membered heterocyclic ring system e.g. an imidazole, oxazole, thiazole, oxadiazole, thiadiazole, thiadiazolidine, diazole, triazole, benzoxazole, benzthiazole, benzimidazole, pyrimidine, tetrazole, quinoline, naphthoxazole, triazine and striazolo[4,3-a]quinoline ring, n is 0 or 1, X is —CO— or —CS—, R represents alkyl including substituted alkyl or aryl including substituted aryl, and Y stands for —CO—, —CO—O—, —CS—, —$SO_2$—, —CON($R_1$)— or —CSN($R_1$)— wherein $R_1$ is hydrogen or has one of the meanings given for R.

Heterocyclic mercaptans as well as derivatives thereof of the kind represented by the above formulae I and II are known for use in silver halide photography as emulsion stabilizers or antifoggants.

For the purpose of the present invention, however, the corresponding heterocyclic mercaptans, from which the compounds of the above formulae are derived, are not suitable.

The derivatives of heterocyclic mercaptans represented by the above general formulae can be prepared from the heterocyclic mercaptans by methods well known to those skilled in the art and described in the literature. They can be prepared as described in Belgian Patent Specification 621,948, German Patent Specification 1,189,380, in the Japanese Patent Publication 17933/68 and in the published German Patent Applications 1,522,363, 1,597,503, 1,797,027, 2,042,533, 2,043,205, and 2,044,622 which all relate to the use of these compounds as emulsion stabilizers or antifoggants.

Though for the derivatives of heterocyclic mercaptans the above general formulae are given it is also possible that in the synthesis of these compounds, more particularly the compounds for which general formula I wherein n is 1 and the compounds for which general formula II has been given, products are formed which correspond to an isomeric structure of said formulae, namely:

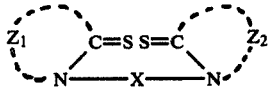

Ia.

and

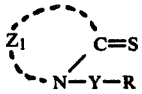

IIa.

wherein:

$Z_1$, $Z_2$, X, Y and R have the same significance as above. Since both isomers are useful for the purpose of the present invention it should be understood that when the above general formulae I and II are given it is also intended to embrace the isomeric compounds of the above formulae Ia and IIa.

The following are representative examples of compounds suitable for use in accordance with the present invention. For convenience's sake they have been given a structure corresponding to formulae I and II above.

1.

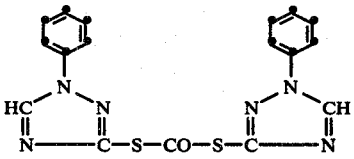

2.

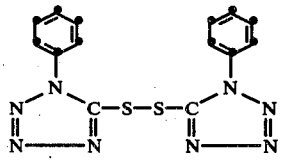

3.

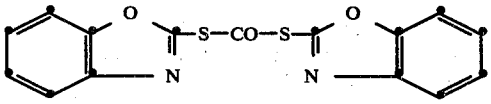

4.

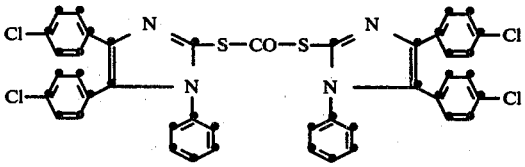

5.

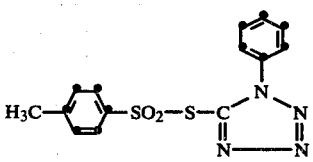

6.

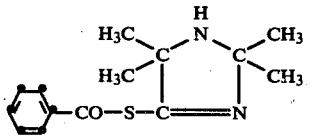

7.

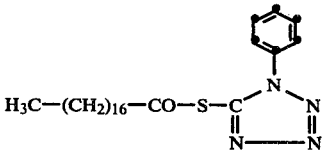

8.

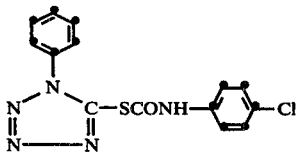

-continued

9.

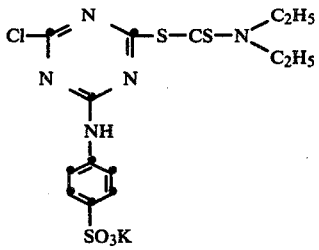

10.

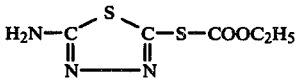

11.

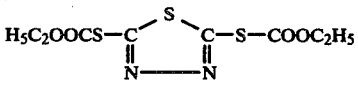

12.

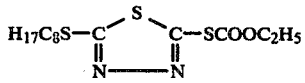

13.

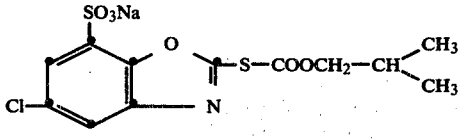

14.

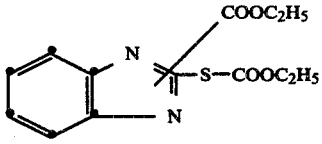

15.

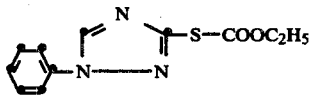

16.

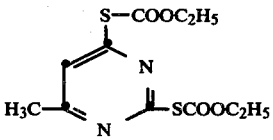

Both in reversal and negative processing of Lippmann-emulsions the use of the compounds according to the present invention results in an enhancement of the image-sharpness, particularly sharpness of fine detail, and in a favourable effect on the distortion of the image-details. Moreover, where reversal processing of Lippmann material is very critical and often gives rise to yellow staining, probably owing to residual oxidation products of the developing agent, it was found that the compounds used according to the invention counteract said yellowing.

The compounds for use in accordance with the present invention are incorporated in the emulsion layer by addition, as a solution or dispersion, to the coating compositions of the Lippmann emulsion.

The concentration of the compounds used according to the invention depends on the characteristics of both the chosen compound and the emulsion and is therefore best determined by trial. In most cases the optimum concentration in the silver halide emulsion is between about 20 mg and about 2 g, preferably between about 100 mg and 1 g per mole of silver halide.

The thickness of the emulsion layer of a photographic material according to the present invention is generally comprised between about 3 microns and about 8 microns, and the average grain size of the silver halide grains is generally less than 80 nm. The ratio of silver halide to hydrophilic colloid binder in the Lippmann emulsion according to the present invention is preferably at least 1:2 and at most 4:1. The silver halide Lippmann emulsions may be prepared according to methods well known in the art and described in the literature (see e.g. P. Glafkidès "Photographic Chemistry," Vol. I, 1958, pages 365–368, Mees/James "The theory of the Photographic Process," 1966, p. 36 and National Physical Laboratory "Notes on Applied Science" no. 20: "Small Scale Preparation of Fine-Grain (Colloidal) Photographic emulsions," B. H. Crawford, London, 1960). They may also be prepared according to the technique described in co-pending United Kingdom patent Application 15,948/70.

Silver halide Lippmann-emulsions with very fine grain can be obtained by effecting the precipitation of the silver halide in the presence of heterocyclic mercapto compounds as described in United Kingdom patent Specification 1,204,623 or in the presence of compounds as described in co-pending United Kingdom patent applications 53025/69 and 54539/69.

The hydrophilic colloid used as the vehicle for the silver halide may be any of the common hydrophilic colloids employed in photographic light-sensitive emulsions for example, gelatin, albumin, zein, casein, alginic acid, collodion, a cellulose derivative such as carboxymethyl cellulose, a synthetic hydrophilic colloid such as polyvinyl alcohol and poly-N-vinyl pyrrolidone, etc. If desired compatible mixtures of two or more colloids may be employed for dispersing the silver halide.

Various silver salts may be used as the light-sensitive salt such as silver bromide, silver iodide, silver chloride, or mixed silver halides such as silver chlorobromide, silver bromoiodide and silver chlorobromoiodide. Silver bromoiodide emulsions having a iodide content of at most 8 mole % and an average grain-size of at most 80 nm are favoured.

The emulsions may be coated on a wide variety of photographic emulsion supports. Typical supports include cellulose ester film, polyvinyl acetal film, polystyrene film, polyethylene terephthalate film and related films of resinous materials as well as paper and glass. In the manufacture of high-resolution plate materials for the preparation of masks for use in the electronic industry, glass supports are most advantageously used in view of their high dimensional stability.

The light-sensitive silver halide emulsions of use in the preparation of a photographic material according to the present invention may be chemically as well as spectrally sensitized.

They may be spectrally sensitized by any of the known spectral sensitizers such as cyanines and merocyanine dyes for photographic light-sensitive silver halide materials. The silver halide emulsions for microelectronic mask making according to the present invention are most advantageously sensitized for the green region of the spectrum. The exposure light is preferably chosen so that it radiates light of a wavelength to which the emulsion has been spectrally sensitized.

They may be chemically sensitized by effecting the ripening in the presence of small amounts of sulphur containing compounds such as allyl thiocyanate, allyl thiourea, sodium thiosulphate, etc. The emulsions may also be sensitized by means of reductors for instance tin compounds as described in French Pat. Specification 1,146,955 and in Belgian Pat. Specification 568,687, imino-amino methane sulphinic acid compounds as described in United Kingdom patent Specification 789,823 and small amounts of noble metal compounds such as gold, platinum, palladium, iridium, ruthenium and rhodium.

The said emulsions may also comprise compounds which sensitize the emulsion by development acceleration for example compounds of the polyoxyalkylene type such as alkylene oxide condensation products as described among others in U.S. Pat. Nos. 2,531,832 and 2,533,990, in United Kingdom patent Specification 920,637, 940,051, 945,340 and 991,608 and in Belgian Pat. Specification 648,710 and the known onium compounds including quaternary ammonium, quaternary phosphonium and ternary sulphonium compounds as well as onium derivatives of amino-N-oxides as described in United Kingdom patent Specification 1,121,696.

Further the emulsions may comprise stabilizers e.g. heterocyclic nitrogen-containing thioxo compounds such as benzothiazoline-2-thione and 1-phenyl-2-tetrazoline-5-thione and compounds of the hydroxytriazolopyrimidine type. They can also be stabilized with mercury compounds such as the mercury compounds described in Belgian Pat. Specifications 524,121 and 677,337, United Kingdom patent Specification 1,173,609 and in U.S. Pat. No. 3,179,520.

The emulsions may also comprise light-absorbing dyes which are so chosen that they absorb light of the wavelength to which the material is exposed so that scattering and reflection of light within the photographic material is reduced. For more details regarding these dyes there can be referred to Belgian Pat. Specification 699,375 and co-pending United Kingdom patent Application 58,844/68. The dyes are preferably used in such amounts that per micron of emulsion layer thickness a density comprised between 0.05 and 0.20, measured in the spectral region of the exposure light, is obtained.

Any of the hardening agents for hydrophilic colloids may be used in the emulsions according to the present invention such as chromium, aluminium, and zirconium salts, formaldehyde, dialdehydes, hydroxy aldehydes, acrolein, glyoxal, halogen substituted aldehyde acids such as mucochloric acid and mucobromid acid, diketones such as divinyl ketone, compounds carrying one or more vinylsulphonyl groups such as divinylsulphone, 1,3,5-trivinylsulphonyl benzene, hexahydro-s-triazines carrying vinylcarbonyl, halogenoacetyl and/or acyl groups such as 1,3,5-triacryloylhexahydro-1,3,5-triazine, 1,3-diacryloyl-5-acetylhexahydro-1,3,5-triazine, 1,3,5-trichloroacetylhexahydro-1,3,5-triazine, etc.

In order to promote adhesion of the emulsion to glass supports in the preparation of high resolution plate materials, the silicon compounds described in copending United Kingdom patent Application 54,678/68 can be incorporated into the emulsion.

The light-sensitive emulsions may also comprise all other kinds of ingredients such as plasticizers, coating aids, etc.

Though the invention has been particularly described in view of the preparation of masks as used in the production of microelectronic integrated circuits, the compounds described have the same favourable effects in Lippmann-materials used for other purposes where high-resolution and high acutance is of primary importance.

The following examples illustrate the present invention.

EXAMPLE 1

A silver bromide emulsion comprising per kg 72 g of silver bromide and 93 g of gelatin was prepared by simultaneous addition of a silver nitrate solution and a potassium bromide solution to a 3% aqueous solution of gelatin. The conditions of precipitation were adjusted so that a Lippmann emulsion with an average grain size of 70 nm was obtained. Details as to the preparation of Lippmann emulsions can be found amongst others in P. Glafkidès "Photographic Chemistry," Vol. I, 1958, Fountain Press, London.

The emulsion was sensitized by addition of 150 mg per 100 g of silver halide of a merocyanine dye by means of which a strong spectral sensitization in the region of 520–550 mμ was obtained. Then, an amount of the light-absorbing dye having the following structural formula:

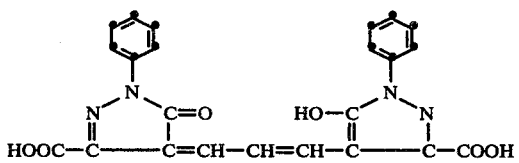

was added so as to obtain, after the emulsion portions were coated, a density of 0.10 per micron of emulsion layer thickness, measured at 550 mμ (absorption maximum of the light-absorbing dye used).

The emulsion was divided into 5 portions and to each portion, except for one, one of the compounds 1, 5, 7 and 10 was added in an amount of 500 mg per mole of silver halide.

The emulsion portions were coated on glass plates pro rata of 230 ml per sq.m so as to obtain after drying a layer thickness of 6 μ. The 5 plate materials A, B, C, D and E were then exposed under identical circumstances by means of monochromatic light, the spectral composition of which corresponds with the absorption region of the light-absorbing dye used, through a test pattern, as normally used for the quantitative evaluation of materials for use in microelectronics mask-making, consisting of lines which are separated by spaces of the same width as the lines themselves and with a width varying from 1 to 20 μ. The exposure was of such an intensity so as to limit the density in the transparent areas of the images produced, which correspond with the white lines of the test pattern, to the fog value.

After the exposure the 5 plate materials were reversal processed at 20° C., under completely identical circumstances.

For that purpose the exposed materials were first developed for about 5 min. in the following developing liquid the pH of which was adjusted to 10.5:

| | |
|---|---|
| hydroquinone | 2 g |
| monomethyl-p-aminophenol hemisulphate | 4 g |
| potassium bromide | 2 g |
| sodium carbonate | 40 g |
| sodium sulphite | 40 g |

-continued

| | |
|---|---|
| potassium thiocyanate | 5 g |
| water to make | 1 liter. |

The materials were then treated for about 5 min. in the following bleach bath:

| | |
|---|---|
| potassium dichromate | 5 g |
| strong sulphuric acid (d = 1.85) | 10 ccs |
| water to make | 1000 ccs. |

After rinsing for some minutes in water the materials were treated for 5 minutes in a clearing bath of the following composition:

| | |
|---|---|
| sodium sulphite | 100 g |
| water to make | 1000 ccs |

After rinsing again for some minutes the materials were subjected to an overall exposure in order to render the residual silver bromide developable whereupon they were treated for about 6 minutes in the following developing liquid:

| | |
|---|---|
| hydroquinone | 5 g |
| monomethyl-p-aminophenol hemisulphate | 1 g |
| sodium sulphite | 40 g |
| sodium carbonate | 30 g |
| potassium bromide | 0.5 g |
| water to make | 1000 ccs |

Finally the materials were rinsed and dried.

From the results obtained it was clearly apparent that as compared with materials B, C, D and E, material A, to which no compound of the invention was added, showed image distortions, especially at the areas where lines of 10 to 20 μ were reproduced, and was inferior as regards yellow staining and edge sharpness.

We claim:

1. A method of microphotography including the steps of negative or reversal development of an exposed Lippmann emulsion to create an image, said emulsion at the time of development comprising a derivative of a heterocyclic mercaptan corresponding to one of the following formulae I and II:

I.

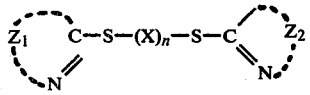

II.

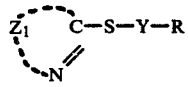

wherein:

each of $Z_1$ and $Z_2$ represents the atoms necessary to complete a 5- or 6-membered heterocyclic ring system, n—is 0 or 1, X—is —CO— or —CS—, R—represents an alkyl group or an aryl group, and Y—is —CO—, —COO—, —CS—, —$SO_2$—, —CON($R_1$)— or —CSN($R_1$)— wherein $R_1$ is hydrogen, an alkyl group or an aryl group in an amount sufficient to enhance image sharpness and reduce distortion of the image.

2. Method of claim 1, wherein each of $Z_1$ and $Z_2$ represents the atoms necessary to close an imidazole, oxazole, thiazole, oxadiazole, thiadiazole, thiadiazolidine, diazole, triazole, benzoxazole, benzthiazole, benzimidazole, pyrimidine, tetrazole, quinoline, naphthoxazole, triazine or s-triazolo[4,3-a]quinoline ring.

3. Method of claim 1, wherein the said derivative is incorporated into said Lippmann emulsion in an amount of from about 20 mg and 2 g per mole of silver halide.

4. Method of claim 1, wherein the ratio of silver halide to hydrophilic colloid binder in the Lippmann emulsion is from about 1:2 and 4:1.

5. Method of claim 1, wherein the said emulsion is a silver bromoiodide emulsion having a iodide content of at most 8 mole percent and an average grain size of at most 80 nm.

6. Method of claim 1, wherein the support is a glass support.

* * * * *